United States Patent [19]

Berkenhoff

[11] 4,135,232

[45] Jan. 16, 1979

[54] SPOT-LIGHT REFLECTOR STRUCTURE

[75] Inventor: Hans-Peter Berkenhoff, Lüdenscheid, Fed. Rep. of Germany

[73] Assignee: Hoffmeister-Leuchten K. G., Lüdenscheid, Fed. Rep. of Germany

[21] Appl. No.: 865,477

[22] Filed: Dec. 29, 1977

Related U.S. Application Data

[63] Continuation of Ser. No. 701,379, Jun. 30, 1976, abandoned.

[51] Int. Cl.[2] ..... F21V 7/00; F21V 7/06

[52] U.S. Cl. ..... 362/306; 362/310; 362/346; 362/368

[58] Field of Search ..... 362/298, 303, 306, 310, 362/346, 368, 370

[56] References Cited

U.S. PATENT DOCUMENTS

| | | | |
|---|---|---|---|
| 1,967,342 | 7/1934 | Upmeyer | 362/298 |
| 1,970,345 | 8/1934 | Speranza | 362/298 |
| 2,071,159 | 2/1937 | Benjamin | 5/17 |
| 2,428,479 | 10/1947 | Tsouros | 362/306 |
| 2,733,336 | 1/1956 | Clayton | 362/306 |
| 3,381,126 | 4/1968 | Steiner | 362/368 |

FOREIGN PATENT DOCUMENTS

| | | | |
|---|---|---|---|
| 6531 | 4/1904 | Denmark | 362/304 |

*Primary Examiner*—Peter A. Nelson
*Attorney, Agent, or Firm*—Erwin Salzer

[57] ABSTRACT

A spot-light reflector structure is made up of two reflector bodies, a main reflector body and an auxiliary reflector body both of which have a shape which is, in part, that of a paraboloid of revolution. Both reflector bodies are arranged in coaxial relation. The main reflector body has a central aperture and is nonparabolic in the region around said aperture. The auxiliary reflector body is arranged inside of the main reflector body and has an upper portion which is substantially hemispherical and has a central aperture which is arranged in coaxial relation to the central aperture of the main reflector body. The central aperture of the auxiliary reflector body is surrounded by a tubular extension which forms preferably an integral part thereof and which is in the shape of a paraboloid of revolution of considerably smaller size than that of the main reflector body.

3 Claims, 2 Drawing Figures

SPOT-LIGHT REFLECTOR STRUCTURE

BACKGROUND OF THE INVENTION

This application is a continuation of application Ser. No. 701,379, filed on June 30, 1976, and now abandoned.

This invention refers to spot-light reflectors and has several objects. One of its objects is to provide a spot-light combining great simplicity and efficiency so that a large portion of the light emitted from the incandescent filament of an incandescent lamp is directed to the spot intended to be illuminated. Another object is to provide spot-light reflectors allowing to use incandescent standard lamps, i.e. reflectors which are not limited to special spot-light lamps. Still another object of the invention is to provide reflectors which are made up of a main reflector body and of an auxiliary reflector body and in which the latter is readily removable to facilitate the replacement of burned-out incandescent lamps. A further object of the invention is to minimize the portion of the total light emission of an incandescent lamp which is converted into heat.

SUMMARY OF THE INVENTION

Spot-light reflector structures embodying this invention include a main reflector body which is curved substantially parabolically and defines a central aperture in the peak region thereof adapted to receive the neck of an incandescent lamp. Light reflector structures embodying this invention further include a removable substantially hemispherical auxiliary reflector body arranged to be positioned in front of the bulbous portion of an incandescent lamp placed into said main reflector body and to reflect a portion of the light emitted from said incandescent lamp in forward direction back to said main reflector body. Said auxiliary reflector body defines a central aperture for the passage of light through said auxiliary reflector body, and said aperture in said auxiliary reflector body being arranged substantially in registry with said central aperture in said main reflector body.

DESCRIPTION OF PREFERRED EMBODIMENT

Figure 1:
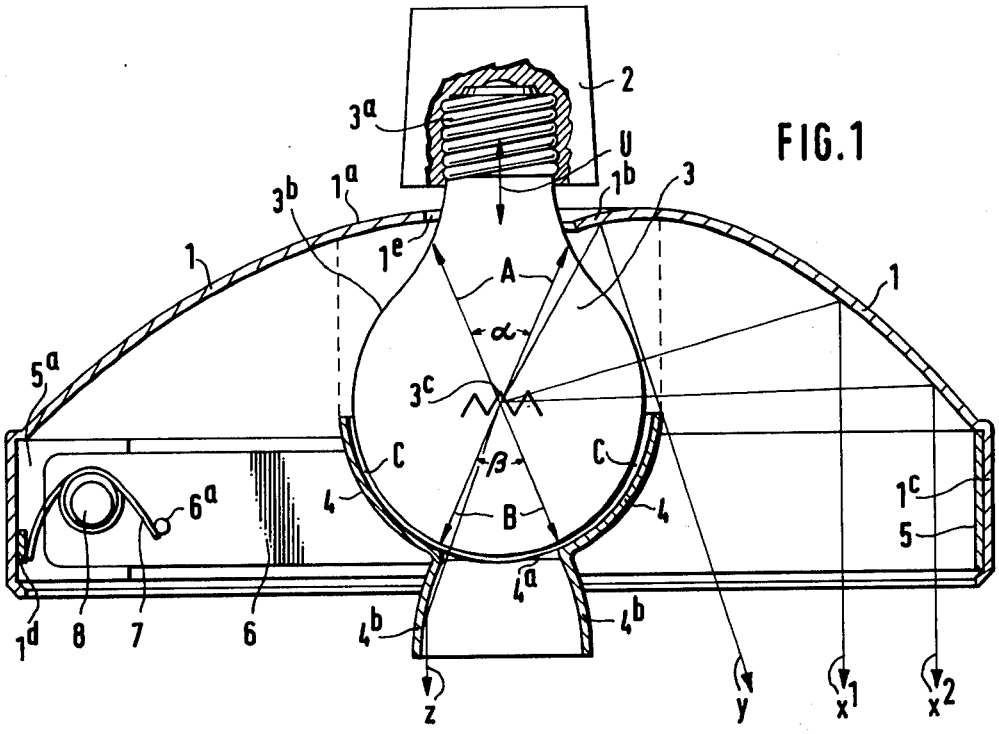
FIG. 1 is substantially a vertical section through a spot-light embodying this invention with a standard incandescent lamp placed into it.
Figure 2:
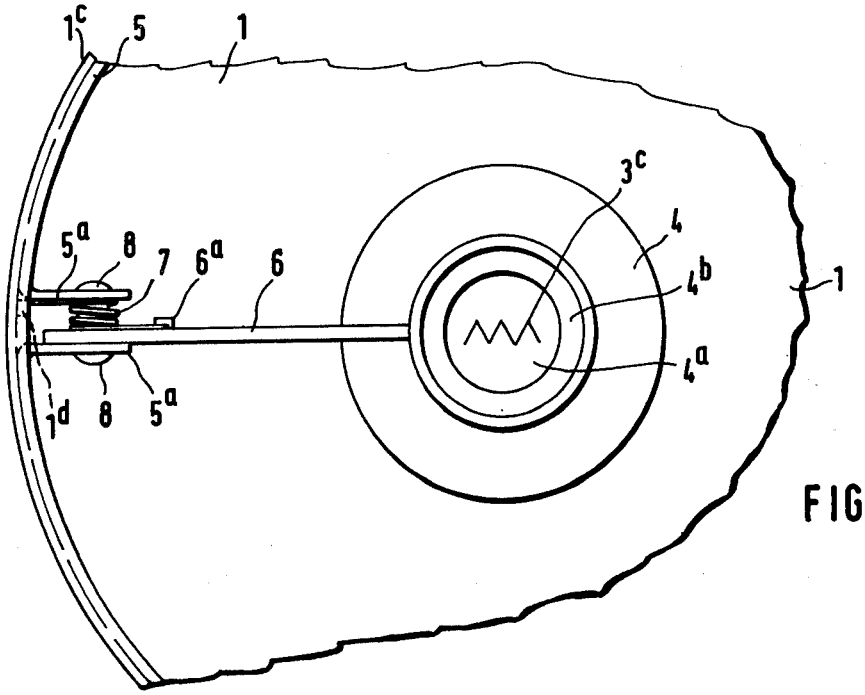
FIG. 2 is a partial bottom-plan view of the structure shown in FIG. 1.

In the drawings reference numeral 1 has been applied to indicate a main reflector body which is curved substantially parabolically, i.e. has substantially the shape of a paraboloid of revolution. The reflector body 1 proper is provided on its lower wide end with a cylindrical rim $1^c$ which forms an integral part of the main reflector body 1 proper. Reflector body 1 defines a central aperture $1^e$ in the peak region thereof. The lamp socket 2 indicated diagrammatically is arranged outside of reflector body 1 and receives the screw-threaded portion $3^a$ of the neck of an incandescent lamp 3. An annular member 5 encompassing slightly less than 360 deg. is arranged inside of cylindrical rim $1^c$. The ends $5^a$ of member 5 are bent inwardly and arranged in parallel relation and form a supporting bracket. Member 5 is flexible and tends to expand and is, therefor maintained by friction inside of rim $1^c$. Stud or rivet 8 projects transversely through supporting bracket $5^a$ and supports an arm 6 and a helical biasing spring 7. Arm 6 is pivotable about stud 6 and projects radially inwardly from its point of support. The radially inner end of arm 6 supports a substantially hemispherical auxiliary reflector body 4 defining a central aperture $4^a$ which is arranged substantially in registry with the aperture $1^e$ in the main reflector body 1. One end of helical mousetrap spring 7 rests against pin $1^d$ on member $1^c$ and the other end of spring 7 rests against an abutment $6^a$ on arm 6. As a result, arm 6 and reflector 4 are biased in counterclockwise direction as seen in FIG. 1 and the latter envelopes the bulbous portion bottom $3^b$ of the incandescent lamp 3. The arrangement is made such that the auxiliary reflector body 4 does not physically engage the bulbous portion $3^b$ of the incandescent lamp 3, but that a small gap C is left between both of them. Lever 6 may be pivoted in clockwise direction as seen in FIG. 1 against the bias of spring 7 to get access to lamp 3 in order to replace the same. Spring 7 further tends to increase the spacing between the parallel bracket arms $5^a$, as a result of which the annular element 5 is expanded and engages more firmly the cylindrical portion $1^c$ of main reflector 1. The width of element 5 may be narrower than shown in the drawing, as a result of which the structure 4–8 may be slightly moved in axial direction so to adjust the width of gap C between auxiliary reflector 4 and the bulbous portion $3^b$ of incandescent lamp 3. Such an adjustment of gap C if proper precludes an overheating of incandescent lamp 4 and a consequent reduction of the life thereof.

As shown in FIG. 1 light rays emitted from the incandescent filament $3^c$ of lamp 3 are reflected from the parabolic surface thereof in parallel direction as indicated at $x^1$ and $x^2$. Light rays which are emitted from filament $3^c$ rearwardly within the space of the cone A having the angle $\alpha$ leave the main reflector body 1 by way of aperture $1^e$ and are ultimately absorbed and converted into heat. However, light rays which are emitted from filament $3^c$ forwardly within the space of the cone B having the angle $\beta$ pass through the central aperture $4^a$ in reflector body 4 and used to illuminate the area intended to be illuminated. As shown in FIG. 1 auxiliary reflector 4 has a tubular extension $4^b$ projecting forwardly from central aperture $4^a$ and has a light reflecting inner surface which is shaped substantially parabolically, i.e. has the shape of a parabloid of revolution. Therefore light rays incident on the inner surface of tubular extension $4^b$ are reflected forwardly, i.e. parallel to light rays $x^1$ and $x^2$. One such light ray is shown in FIG. 1 and indicated by the reference character z.

The incandescent lamp 3 may be slightly shifted axially in forward or rearward direction as indicated by the dual arrow u. Thus the filament $3^c$ may be slightly adjusted relative to the focal point of the main reflector body 1. Such shifting allows to vary the direction of light rays $x^1$ and $x^2$ from strict parallelism to slight divergence. The adjustment of the filament $3^c$ of lamp 3 may be coupled with an adjustment of the reflector body 4 (not illustrated in the drawing) which results in greater efficiency irrespective of whether a slightly divergent or a strictly parallel light beam is desired.

As clearly shown in FIG. 1 the region $1^b$ of the main reflector body 1 immediately adjacent the central aperture $1^e$ thereof is curved non-parabolically in axial inward direction. As a result of this configuration, light incident upon the region $1^b$ of reflector body 1 is not entirely lost, but reflected forwardly as indicated by the light ray y. It is apparent that if the peak region of reflector body 1 were parabolic rather than deviating from the strictly parabolic shape, as shown in FIG. 1, light rays incident upon the peak region of the main reflector body 1 would be reflected back into the cavity defined by reflector body 4.

The diameter of the aperture $4^a$ in the auxiliary reflector body 4 may be in the order of 1".

The parts 4 and $4^b$ might be affixed to main reflector body 1 by means other than those shown in the drawings, though the means shown therein is the preferred mode of embodying this invention. As an alternative, parts 4 and $4^b$ might be affixed to main reflector body 1 by means of a louvre structure supporting the first mentioned parts in the center region thereof.

As mentioned before, the reflecting surfaces of main reflector body 1 and of the tubular extension $4^b$ of auxiliary reflector body 4 are both curved substantially parabolically. The focal points of the main reflector body 1 and that of the tubular extension $4^b$ of auxiliary reflector body 4 ought to coincide as far as this is feasible.

It will be apparent from the foregoing that the bundle of light rays passing through aperture $4^a$ form a desirable addition to the light rays reflected from the inner surface of main reflector body 1.

The incandescent filament $3^c$ of the incandescent lamp 3 may be considered to approximate a point light source. The diameters of the two apertures $1^e$ and $4^a$ ought to be substantially proportional to their distances from the incandescent filament $3^c$ in order to fully achieve the ends of this invention.

The loss of light is practically limited by the size of the aperture $1^e$ in the main reflector body 1 which is relatively small, even if standard lamps are used whose neck is of larger diameter than that of special lamps intended for the purpose in hand.

The mechanism which has been described above assures that the movable parts 4, $4^b$ always return to their proper axial positions, so that no misalignment thereof can occur and no adjustment thereof is ever necessary.

I claim as my invention:

1. A spot-light reflector structure for incandescent lamps comprising in combination (a) a substantially parabolic main reflector whose inner surface reflects light and whose outer surface separates a space for accommodating an incandescent lamp from its surroundings, said reflector having a passage for the neck of an incandescent lamp in the apex region thereof and said reflector having a cylindrical projection at the wide end opposite said apex region forming a duct which is open at the front side thereof;

(b) a single auxiliary reflector having the shape of a full hemisphere arranged in coaxial relation to said main reflector and positioned to be narrowly spaced from the bulbous portion of an incandescent lamp, said auxiliary reflector having an aperture in the peak region thereof;

(c) a tubular extension projecting forwardly from said aperture and forming a third light reflector on the inner surface thereof;

(d) a substantially cylindrical insert inside said cylindrical projection of said main reflector positioned by friction inside said cylindrical projection;

(e) a radially extending arm supporting said auxiliary reflector at one end thereof and being pivotally supported at the opposite end thereof by said insert; and (f) a mouse-trap type spring having one end resting against said projection of said main reflector and another end resting against said arm and biasing said arm and said auxiliary reflector toward the space intended to be occupied by an incandescent lamp whereby said arm and said auxiliary reflector are allowed against the action of said mouse-trap type spring to be moved away from an incandescent lamp arranged in said main reflector to allow ready replacement of an incandescent lamp through said open front of said cylindrical projection of said main reflector.

2. A spot-light reflector structure for incandescent lamps comprising (a) a substantially parabolically shaped member forming both the outer casing for an incandescent lamp and also forming a parabolic reflector for light emitted from said lamp, said member having a central aperture in the apex region thereof adapted to receive the neck of an incandescent lamp, and said member further having a cylindrical rim at the end thereof opposite said apex region forming an open duct;

(b) a substantially fully hemispherical one piece auxiliary reflector arranged in coaxial relation to said parabolically shaped member and adapted to be positioned in front of the bulbous portion of an incandescent lamp and to reflect light emitted from said incandescent lamp in forward direction back to said parabolically shaped member;

(c) an arm biased by a helical spring being pivotally supported at one end thereof adjacent said rim of said parabolically shaped member and supporting on the other end thereof said auxiliary reflector, said arm allowing said auxiliary reflector to be pivoted in such a way as to allow substitution of an incandescent lamp by another; and (d) said auxiliary reflector having an aperture therein in the peak region thereof and a tubular extension substantially in the shape of a parabloid of rotation one end of which is coextensive with said aperture of said auxiliary reflector projecting from said aperture and having a light reflecting inner surface.

3. A spot-light reflector for incandescent electric lamps comprising (a) a lamp enclosure having a single casing-reflector member whose outer surface separates the space for receiving an incandescent lamp from its environment and whose inner surface forms a light reflector, said member including an open cylindrical end portion, an intermediate parabolic reflector portion and an apex portion having an aperture for the neck of an incandescent lamp and being curved non-parabolically and bent axially inwardly at the region thereof immediately adjacent said aperture;

(b) a single all-hemispherical auxiliary reflector arranged inside said casing-reflector member in coaxial relation thereto and adapted to be positioned with a narrow spacing in front of the bulbous portion of an incandescent lamp to reflect in backward direction light emitted from said lamp in forward direction;

(c) said hemispherical reflector having an aperture at the peak region thereof and a tubular parabolic reflector arranged in coaxial relation with said aperture; and (d) an arm supporting said hemispherical auxiliary reflector on one end thereof and being pivotally supported by said cylindrical end portion of said casing-reflector member on the other end thereof, said arm being under the bias of a helical spring and allowing to move said hemispherical reflector and said tubular parabolic reflector out of the normal position thereof so as to give direct access to an incandescent lamp inside said casing-reflector member and allow a simple replacement of such a lamp.

* * * * *